US009242773B1

(12) United States Patent
Anderson

(10) Patent No.: US 9,242,773 B1
(45) **Date of Patent: *Jan. 26, 2016**

(54) DISPENSING CAPSULE WITH BUTTON BLAST AND DRINKING FEATURE

(71) Applicant: Michael R. Anderson, Deerfield Beach, FL (US)

(72) Inventor: Michael R. Anderson, Deerfield Beach, FL (US)

( * ) Notice: Subject to any disclaimer, the term of this patent is extended or adjusted under 35 U.S.C. 154(b) by 247 days.

This patent is subject to a terminal disclaimer.

(21) Appl. No.: 13/849,155

(22) Filed: Mar. 22, 2013

Related U.S. Application Data

(63) Continuation-in-part of application No. 13/478,419, filed on May 23, 2012, now Pat. No. 9,132,950, and a continuation-in-part of application No. 13/480,958, filed on May 25, 2012, now Pat. No. 8,839,982.

(60) Provisional application No. 61/490,971, filed on May 27, 2011, provisional application No. 61/490,920, filed on May 27, 2011.

(51) Int. Cl.
*B65D 81/32* (2006.01)
*B65D 51/28* (2006.01)

(52) U.S. Cl.
CPC ..... *B65D 51/2828* (2013.01)

(58) Field of Classification Search
CPC ..... B65D 81/32; B65D 81/3211; B65D 81/3205; B65D 81/3255; B65D 51/28; B65D 51/2814; B01F 13/005; A61J 1/2096; Y10S 215/08
USPC ..... 206/222, 219, 220, 568; 215/DIG. 8; 220/521; 222/83
See application file for complete search history.

(56) References Cited

U.S. PATENT DOCUMENTS

| | | | | | |
|---|---|---|---|---|---|
| 3,220,588 | A * | 11/1965 | Lipari | 206/222 |
| 3,347,410 | A * | 10/1967 | Schwartzman | 222/80 |
| 5,593,028 | A * | 1/1997 | Haber et al. | 206/221 |
| 5,782,345 | A * | 7/1998 | Guasch et al. | 206/222 |
| 5,927,549 | A * | 7/1999 | Wood | 222/83 |
| 6,003,728 | A * | 12/1999 | Elliott | 222/81 |
| 6,116,445 | A * | 9/2000 | Ikemori et al. | 215/301 |
| 6,148,996 | A * | 11/2000 | Morini | 206/222 |
| 6,305,576 | B1 * | 10/2001 | Leoncavallo | 222/83.5 |
| 7,178,683 | B2 | 2/2007 | Birkmayer et al. | |
| 7,882,976 | B1 * | 2/2011 | Goede | 220/258.1 |
| 8,016,104 | B2 * | 9/2011 | Hjalmarsson | 206/219 |
| 2005/0211579 | A1 * | 9/2005 | Makita | 206/219 |
| 2010/0163509 | A1 * | 7/2010 | Hoffa et al. | 215/228 |
| 2010/0236952 | A1 * | 9/2010 | Masterson et al. | 206/222 |
| 2011/0174642 | A1 * | 7/2011 | Coon | 206/222 |

* cited by examiner

*Primary Examiner* — Steven A. Reynolds
(74) *Attorney, Agent, or Firm* — Malin Haley DiMaggio & Bowen, P.A.

(57) ABSTRACT

A dispensing capsule including a cap body having an outer race, an ingredient storage chamber, an upper sealing member, and a lower sealing member; a hollow plunger slidingly disposed within the chamber; an actuating cover disposed at a top portion of the cap body including a flexible actuator and an internal punch. The internal punch is disposed on an underside of the flexible actuator. The flexible actuator is configured to deform downward causing the internal punch to puncture the upper sealing member and engage the hollow plunger, causing a distal end of the hollow plunger to puncture the lower sealing member, therefore dispensing an ingredient stored in the ingredient storage chamber.

5 Claims, 5 Drawing Sheets

DISPENSING CAPSULE WITH BUTTON BLAST AND DRINKING FEATURE

CROSS REFERENCE TO RELATED APPLICATIONS

This application is a continuation-in-part of co-pending U.S. patent application Ser. No. 13/478,419 filed May 23, 2012, which claims the benefit of priority to U.S. Provisional Patent Application No. 61/490,971 filed May 27, 2011. This application is also a continuation-in-part of co-pending U.S. patent application Ser. No. 13/480,958 filed May 25, 2012, which claims the benefit of priority to U.S. Provisional Patent Application No. 61/490,920 filed May 27, 2011.

STATEMENT REGARDING FEDERALLY SPONSORED RESEARCH OR DEVELOPMENT

N/A

BACKGROUND OF THE INVENTION

1. Field of the Invention

The present invention generally relates generally to dispenser capsules for various ingredients and more particularly to a chambered dispensing capsule having a flexible button blast and a drinking channel for use on a variety of containers and in conjunction with a variety of ingredients.

2. Description of Related Art

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like; however, the majority of the available devices rely on a plurality of interconnected parts which are not cost effective to manufacture and assemble. The present invention is designed to be inexpensive to mass produce, fill and seal to be able to deliver an affordable dispensing capsule in virtually any application and category. This invention can be made from a one piece mold or more pieces depending on the desired application with features and benefits for keeping ingredients separate and fresh until time of use. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more. Moreover, the present invention is particularly useful because it includes a drinking channel which allows the user to access the contents of a mixture without needing to remove the dispensing capsule. This provides a substantial improvement over the prior art with respect to shelf life and overall versatility.

It is, therefore, to the effective resolution of the aforementioned problems and shortcomings of the prior art that the present invention is directed. However, in view of the container and dispensing capsules and related devices in existence at the time of the present invention, it was not obvious to those persons of ordinary skill in the pertinent art as to how the identified needs could be fulfilled in an advantageous manner.

SUMMARY OF THE INVENTION

The present invention provides a dispensing capsule comprising a cap body having an outer race, an ingredient storage chamber, an upper sealing member, and a lower sealing member; a hollow plunger slidingly disposed within the chamber; an actuating cover disposed at a top portion of the cap body comprising a flexible actuator and an internal punch. The internal punch is disposed on an underside of the flexible actuator. The flexible actuator is configured to deform downward causing the internal punch to puncture the upper sealing member and engage the hollow plunger, causing a distal end of the hollow plunger to puncture the lower sealing member, therefore dispensing an ingredient stored in the ingredient storage chamber.

In some embodiments, the outer race of the cap body includes internal threads configured to threadably engage a container, which container may also contain an ingredient for mixing with the ingredient stored in the capsule. In some embodiments, the flexible actuator comprises a bellow-type or flexible stepped actuator that is easily depressed by manual force. The internal punch may comprise a cross-shaped cross section and may have a relatively sharp distal tip, although other configures are envisioned.

The dispensing capsule include pass-through drinking capabilities wherein a top portion of said cap body further includes a drinking spout and defines a pass-through access channel from the storage chamber through the spout. The hollow plunger may include a nozzle having one or more slots such that the plunger does not interfere with the pass-through access channel. A dust cover may be removably received on the actuating cover. In some embodiments, the actuating cover is hingeably connected to the cap body for easy access to the drinking spout once the dispensing capsule has been activated.

Accordingly, it is an object of the present invention to provide a dispensing capsule that provides for easy dispensing and mixing of ingredients while also providing a pass-though access or drinking channel so that the user does not have to remove the dispensing capsule to access the contents.

It is another object of the present invention to provide an easy to operate dispensing capsule with drinking features that is capable of containing a variety of ingredients and is attached to another container for mixing of ingredients.

In accordance with these and other objects which will become apparent hereinafter, the instant invention will now be described with particular reference to the accompanying drawings.

DETAILED DESCRIPTION

Figure 1:
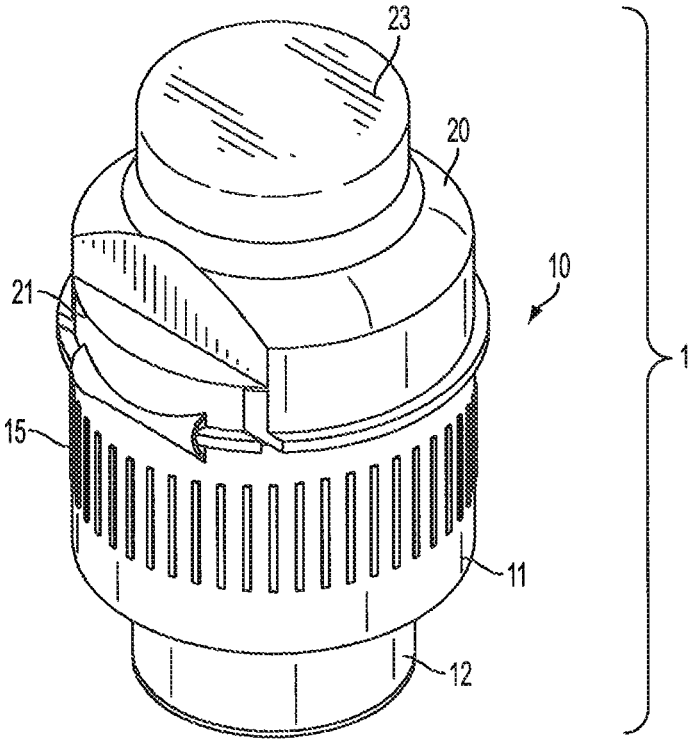
FIG. 1 is a perspective view of one embodiment of the dispensing capsule of the present invention.

With reference FIGS. 1-4, the dispensing capsule 1 generally comprises a cap body 10 having an outer race 11, a chamber 12, an upper sealing member 13, and a lower sealing member 14. In some embodiments, the outer race 11 includes a manual gripping area 15 and internal threads 16 on the inside thereof. The internal threads 16 are adapted to threadingly engage a container, such as a bottle, IV bag, or the like as further shown and described below. In some embodiments, the upper sealing member 13 is located at a top portion of a tapered spout 17 extending upward from the cap body 10. The spout 17 forms at least a portion of the chamber 12, which chamber extends below the outer race 11. The lower sealing member 14 is disposed at the bottom of chamber 12. The upper and lower sealing members 13 and 14 are preferably resilient yet frangible.

Figure 2:
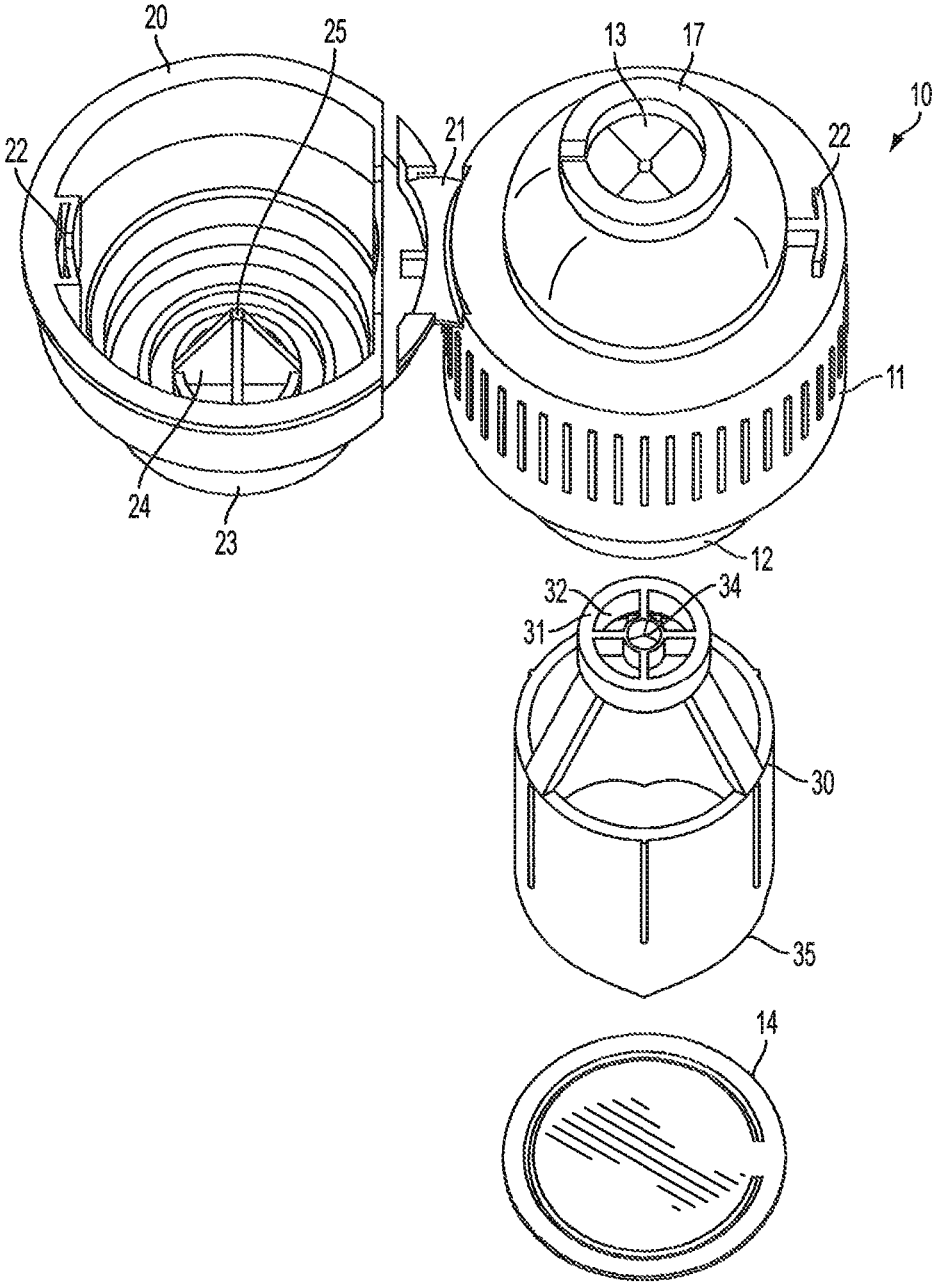
FIG. 2 is an exploded view of one embodiment of the dispensing capsule of the present invention.
Figure 3:
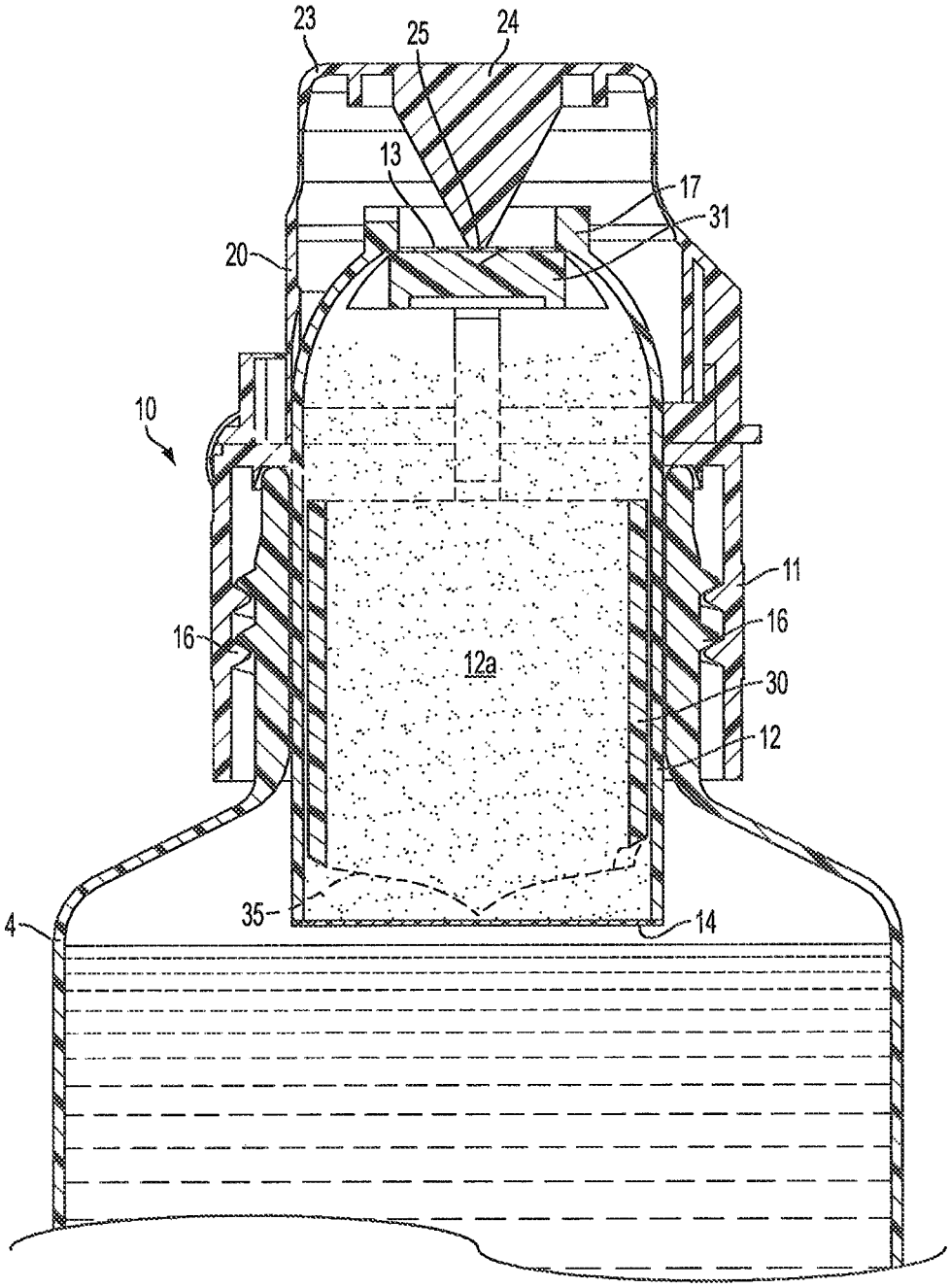
FIG. 3 is a section view of one embodiment of the dispensing capsule of the present invention.

With reference to FIGS. 1-2, provided over the top portion of the cap body 10 is a actuating cover 20 which may be hingeably attached to cap body 10 by hinge 21. In some embodiments, the inside of the actuating cover 20 may include a receiving channel 22 which is configured to engage a protrusion 22*a* on the cap body 10 which allows the cover 20 to be releasably engage and/or lock to the cap body 10. The top portion of the actuating cover 20 comprises a flexible actuator 23 which may comprise a bellow or stepped-blast type actuator 23 comprised of a rubber, plastic, or combinations thereof and other like materials. An additional dust cover may be disposed over the top of the actuator cover 20 to prevent accidental activation of flexible actuator 23.

With reference to FIGS. 2-5, disposed within the cover 20 and extending from the underside of the flexible actuator 23 is an internal punch 24. Internal punch 24 comprises a protrusion extending from the underside of the flexible actuator 23 and may be configured to have a relatively sharp distal tip 25. In some embodiments, the punch 24 has a "cross-shaped" cross section (or "plus-sign" cross-section) which tapers outward to the distal tip 25. The punch 24 is located on the underside of the actuator 23 such that it substantially aligns with the upper sealing member 13 when the cover 20 is closed. In some embodiments, the punch 24 is integrated into the underside of the flexible actuator 23 and may be extruded therefrom.

Referring back to FIGS. 2-4, disposed within and slidingly engaged with the chamber 12 is a hollow plunger 30. Plunger 30 is configured such that it is accommodated by the matching internal dimensions and configuration of the chamber 12, including the tapered spout 17. The top of plunger 30 includes a nozzle 31 which includes one or more slots 32 or apertures thereon. In some embodiments, the slots 32 comprise one or more circumferential slots disposed around the nozzle 31. In some embodiments, the nozzle 31 of plunger 30 extends into the spout 17 such that it is adjacent to the upper sealing member 13. The distal end 33 of plunger 30 may comprise an angle-cut configuration in order to provide a means to break or pierce the lower sealing member 14, as described in further detail below. The nozzle 31 may include an upper surface 34 which may have a concave shape which is easily engaged with internal punch 24 as described below. In some embodiments, the lower sealing member 14 is attached around the bottom periphery of chamber 12 of cap body 10. However, because plunger 30 is initially disposed completely within chamber 12, the lower sealing member 14 also seals plunger 30 within chamber 12. The distal or bottom end 35 of the plunger 30 includes a comprises a cutting surface for rupturing lower sealing member 14 as described below.

Figure 4:
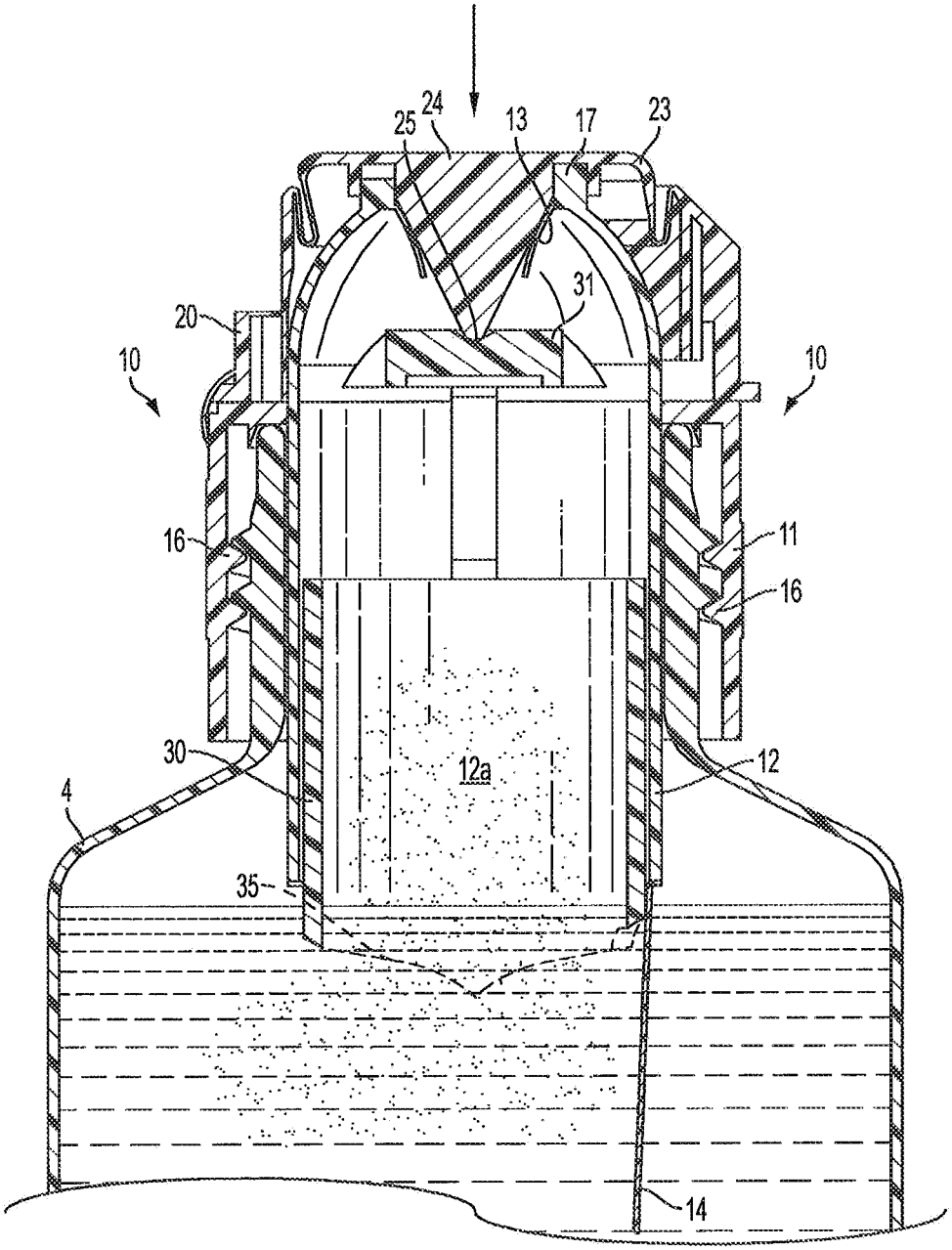
FIG. 4 is another section view of one embodiment of the dispensing capsule of the present invention.

The dispensing capsule 1 of the present invention is configured to store a first ingredient 12*a* within the chamber 12, which chamber is initially sealed at the top and bottom by upper sealing member 13 and lower sealing member 14, respectively, and with hollow plunger 30 also disposed within chamber 12. With reference to FIG. 4, the capsule 1 is configured to selectively dispense the first ingredient from the chamber 12 by depressing the flexible actuator 23 in a downward fashion. As the actuator 23 deforms and travels downward, the internal punch 24 will penetrate the upper sealing member 13 and will then engage and apply downward pressure onto the top portion of hollow plunger 30, at the upper surface 33 of nozzle 31. The continued downward pressure will cause plunger 30 to displace downward at least until the distal end 35 of plunger 30 breaks or punctures lower sealing member 14. Once the lower sealing member 14 is broken, the first ingredient 12*a* will be dispensed from chamber 12. In some embodiments, capsule 1 is attached to a container 4 by the internal threads 16 of the cap body 10 and therefore the first ingredient 12*a* will dispense downward into the container 4 to, for example, be mixed with another ingredient contained in the container 4. In some embodiments, the hollow plunger 30 is resiliently retained within the storage chamber 12 to prevent the hollow plunger 30 from dislodging from the dispensing capsule 1 during operation.

Figure 5:
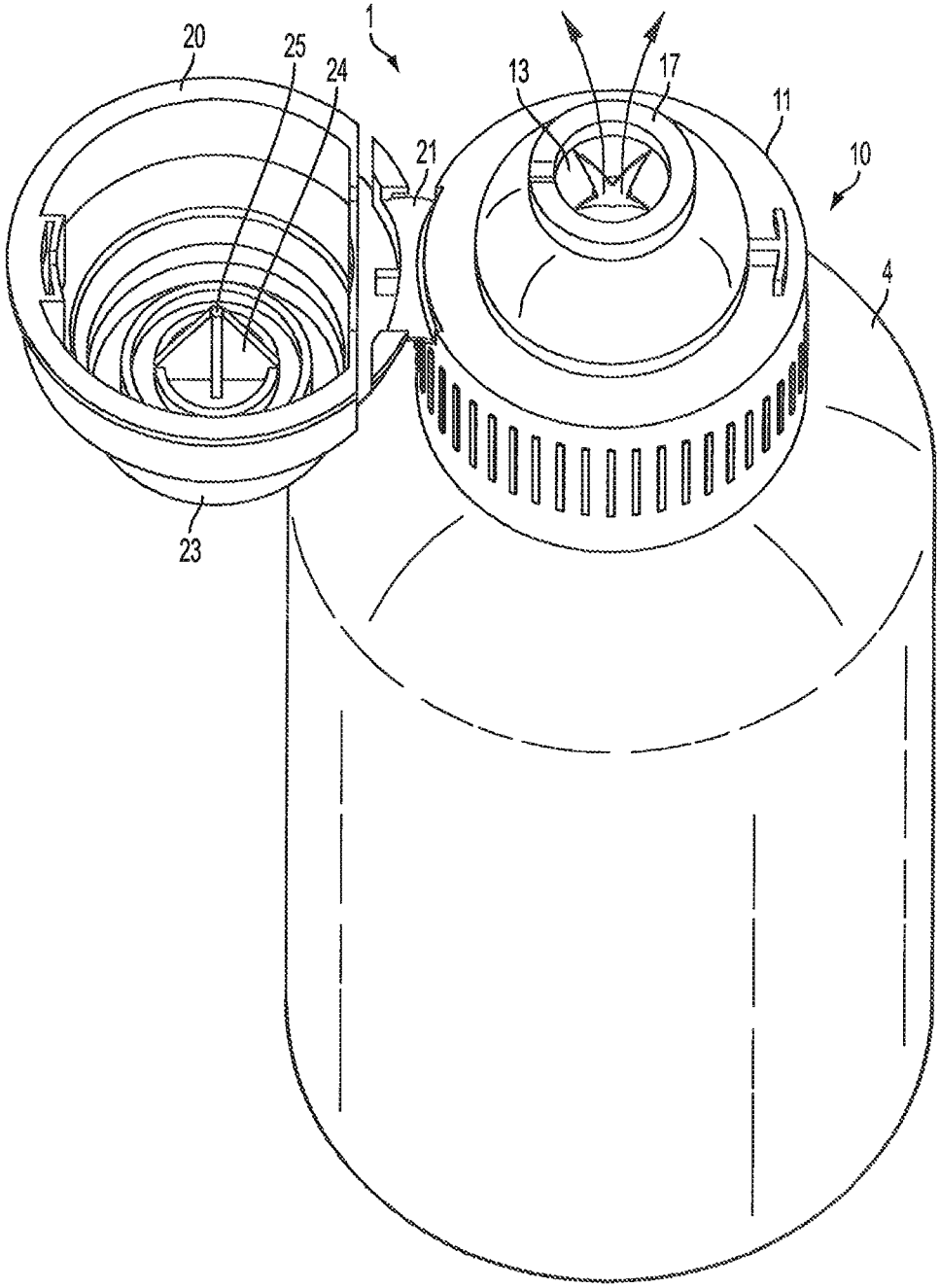
FIG. 5 is top perspective view of the present invention showing the drinking feature.

With reference to FIG. 5, the present invention also provides a means to access or drink the contents of the container 4 without the need to remove the dispensing capsule 1 from the container 4. As such, after the first ingredient 12*a* has been dispensed into container 4 by fully depressing flexible actuator 23, the user may tip or otherwise cause the contents of container 4 to travel back toward the dispensing capsule. The contents will travel into chamber 12, through hollow plunger 30, out of the nozzle 31 of hollow plunger 30 and past the tapered spout 17 out of the top of the cap body 10. Thus, after activated the device completely by way of flexible actuator 23, the capsule 1 results in having internal pass-through access channel through which to access the contents of container 4. In some embodiments, the user can place his mouth directly on tapered spout 17 and drink from the capsule-container engagement in typical fashion, much like a sports bottle or the like. It is appreciated that in some embodiments the upper sealing member 13 and lower sealing member 14 are punctured or broken sufficiently so as to not impede the flow of liquid back through the dispensing capsule and out of the spout 17. It is further appreciated that the cover 20 can be replaced on demand to prevent expulsion of the contents of the container 4 through spout 17. This allows the user to unseal and reseal the capsule 1 as desired from time to time.

It is appreciated that the capsule of the present invention can comprise any combination of materials including plastics, rubbers, aluminum, resins, and the like. The capsule may also be sized and shaped to accommodate fitment on any desired container such as bottles, IV bags, pouches, and the like. Furthermore, the threaded engagement with the container may be substitute for various snap-on or other releasable fitments known in the art.

It is further appreciated that the upper and lower sealing members 13 and 14 may comprise a variety of plastic and foil-like materials. In some embodiments, upper and lower sealing members 13 and 14 comprise a thin plastic or resin material having one or more lines of weakening to allow for dispensing of the first ingredient. In other embodiments, the upper and lower sealing members 13 and 14 may comprise a foil or paper material equally suitable to be broken by the plunger action described above. In some embodiments, the sealing members 13 and 14 are discrete components that are heat sealed, glued, or otherwise attached to the chamber 12. In other embodiments, the sealing members 13 and 14 are coextensively integrated into the chamber 12 but otherwise include lines of weakening or comprise a thin enough or breakable enough material such that the seals break under the pressure of the actuator 23's internal punch and/or bottom of the plunger.

It is appreciated that the chamber 12 can contain any liquid, powder and or gasses and or micro/nano encapsulation in any combination desired. The dispensing capsule can be mounted or applied at any location of a container 4 including a bottle, pouch, can, IV bag, drum or tote. In some embodiments, the capsule is suited to be received on the threaded opening of such containers in order to provide a leak-free fitment. The chamber 12 of the dispensing capsule stores any desired ingredient and may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, beverages, soups, dressings, nitrogen, fuels and engine cleansing, oils, waxes, pH enhancers, oral care, oxygen, adhesives and other categories of use depending on the ingredients and formulas. It is appreciated that the dispensing capsule allows for on-demand dispensing of a product or component of a product for mixing with another ingredient or ingredients in the container to which it is attached. It also provides a means to access or drink directly from the container 4 without needing to remove the capsule first. Also a coating of any type of moisture absorbent can be applied to the inside of the chamber to act as a desiccant and allow for moisture absorption of any excess moisture that may be contained inside the invention when filled and sealed.

This dispensing capsule can be molded in one or two pieces thus eliminating a high cost to manufacture other dispensing caps that are multiple pieces and difficult to fill and seal the ingredients desired. Furthermore, due to the encapsulated capsule excluding the sealing area the invention allows the ingredients to remain moisture free and have an unusually long shelf life and allowing with the sealed chamber to combine liquids and powders and oils and other ingredients to be sealed and stored separately if desired to prevent any reaction with one another. Also the device can include multiple applicators such as drinking spouts, pouring spouts and removable dosing cap for use of a product with one or more multiple chambers and plungers that have flow through to allow dispersing of all ingredients into a desired container. The exact configuration of such spouts and applications is not limited only to those designs shown in figures herein.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, comprising:

a cap body having an outer race, an ingredient storage chamber, an upper sealing member, and a lower sealing member;

a hollow plunger slidingly disposed within said chamber;

an actuating cover disposed at a top portion of said cap body comprising a flexible actuator and an internal punch, said internal punch disposed on an underside of said flexible actuator;

wherein said top portion of said cap body includes a drinking spout and defines a pass-through access channel from said storage chamber through said spout;

wherein said hollow plunger includes a nozzle having one or more slots such that said hollow plunger does not interfere with said pass-through access channel of said cap body, said nozzle including a concave upper surface; and wherein said flexible actuator is configured to deform downward causing said internal punch to puncture said upper sealing member and engage said concave upper surface of said nozzle of said hollow plunger, causing a distal end of said hollow plunger to puncture said lower sealing member, dispensing an ingredient stored in said ingredient storage chamber.

2. The dispensing capsule of claim 1, wherein said outer race of said cap body includes internal threads configured to threadably engage a container.

3. The dispensing capsule of claim 1, wherein said flexible actuator comprises a bellow-type actuator.

4. The dispensing capsule of claim 1, wherein said internal punch comprises a cross-shaped cross section and a distal tip.

5. The dispensing capsule of claim 1, wherein said actuating cover is hingeably attached to said cap body.

* * * * *